US007168885B2

(12) United States Patent
Rio et al.

(10) Patent No.: US 7,168,885 B2
(45) Date of Patent: Jan. 30, 2007

(54) CONTROL SYSTEM AND METHOD FOR A VIBRATORY MECHANISM

(75) Inventors: Federico Mauro John Rio, Bologna (IT); Dean Roger Potts, Maple Grove, MN (US); Kevin Lynn Mann, Bloomington, MN (US)

(73) Assignee: Caterpillar Paving Products Inc, Minneapolis, MN (US)

( * ) Notice: Subject to any disclaimer, the term of this patent is extended or adjusted under 35 U.S.C. 154(b) by 0 days.

(21) Appl. No.: 10/918,370

(22) Filed: Aug. 16, 2004

(65) Prior Publication Data

US 2006/0034657 A1 Feb. 16, 2006

(51) Int. Cl.
*E01C 3/06* (2006.01)
*E01C 11/24* (2006.01)

(52) U.S. Cl. ..... 404/72; 404/75; 404/103; 404/113; 404/122

(58) Field of Classification Search ..... 404/117, 404/122, 72, 75, 103, 113
See application file for complete search history.

(56) References Cited

U.S. PATENT DOCUMENTS 4,127,351 A * 11/1978 Vural ..... 404/72
RE31,195 E * 4/1983 Thurner ..... 73/573
4,481,835 A 11/1984 Storm
4,546,425 A 10/1985 Breitholtz
5,695,298 A * 12/1997 Sandstrom ..... 404/72
6,431,790 B1 * 8/2002 Anderegg et al. ..... 404/75
6,460,006 B1 * 10/2002 Corcoran ..... 702/137
6,551,020 B2 * 4/2003 Swanson et al. ..... 404/117
6,561,729 B1 5/2003 Potts
6,637,280 B2 10/2003 Potts
6,698,974 B2 3/2004 Codina et al.

FOREIGN PATENT DOCUMENTS

EP 0 116 692 A1 8/1984
EP 1 103 658 A2 5/2001
WO WO98/17865 4/1998

* cited by examiner

*Primary Examiner*—Raymond Addie
(74) *Attorney, Agent, or Firm*—Finnegan, Henderson, Farabow, Garrett & Dunner

(57) ABSTRACT

A method is provided for controlling a vibratory mechanism. The method includes sensing a vibratory amplitude of the vibratory mechanism and determining a decoupling point of the vibratory mechanism. An output signal is generated based on the determination of the decoupling point for controlling the vibratory amplitude of the vibratory mechanism.

16 Claims, 3 Drawing Sheets

CONTROL SYSTEM AND METHOD FOR A VIBRATORY MECHANISM

TECHNICAL FIELD

The present disclosure is directed to a control system and method for a vibratory mechanism. More particularly, the disclosure relates to a system and method for controlling amplitude and frequency of a vibratory mechanism.

BACKGROUND

Vibratory work machines such as compactors are often employed to compact soil, gravel, asphalt, and other materials. These vibratory work machines include plate-type compactors and rotating drum compactors. A typical drum compactor has a drum assembly with one or more drums for compacting the material. The drum assembly includes a vibratory mechanism having two or more weights arranged on a shaft rotatable about a common axis within an interior cavity of the drum for inducing vibrations on the drum. The weights are eccentrically positioned with respect to the common axis and are typically movable with respect to each other about the common axis to produce varying degrees of imbalance during rotation of the weights.

The vibratory mechanism provides one or more frequency and amplitude settings. In operation, the vibration amplitude and frequency of a compactor may be changed by a user to suit a particular application. The suitable amplitude and frequency of the vibration may vary depending on the characteristics of the material to be compacted. For example, the vibration amplitude and frequency suitable for compacting gravel for a road may be different from the vibration amplitude and frequency suitable for compacting soil for a footpath. Also, a compacting process may often require compaction with different amplitude and frequency levels at the beginning and end of the process. Furthermore, when a material such as asphalt cools down, its hardness often changes. As a result, compaction with different amplitude and frequency levels may be required based on the temperature of the material.

Vibration amplitude and frequency determine the quality of the compaction, as well as the efficiency of the compaction process. Typically, the amplitude of the vibrations produced by the eccentric weights in the drum assembly may be varied by positioning the weights with respect to each other about their common rotational axis to vary the average distribution of mass (i.e., the centroid) with respect to the rotational axis. In general, vibration amplitude increases as the centroid moves away from the rotational axis of the weights and decreases toward zero as the centroid moves toward the rotational axis. It is also known that varying the rotational speed of the weights about their common axis may change the frequency of the vibrations.

A known vibratory mechanism allows a user to select a desired vibration frequency from one or more possible frequencies independent of the selection of a desired vibration amplitude. In some cases, the vibratory mechanism may enable the user to adjust only vibration amplitude while a vibration frequency remains fixed or uncontrolled, or may enable the user to adjust only vibration frequency while vibration amplitude remains fixed or uncontrolled. For example, U.S. Pat. No. 4,481,835 discloses a device that can continuously adjust a vibration amplitude. However, these known vibratory mechanisms do not establish any relationship or dependency between vibration frequency and vibration amplitude. As a result, a user may be permitted to inadvertently select a vibration frequency and amplitude combination that results in unintended decoupling. Decoupling occurs when a compactor vibrates with a vibratory amplitude that is high enough that the compacting drum becomes airborne.

Thus, the present control system is directed to solving one or more of the shortcomings associated with prior art designs and providing a system and method for controlling a vibratory mechanism with more stability and less interference with the machine performance.

SUMMARY OF THE INVENTION

In one aspect, a method is provided for controlling a vibratory mechanism. The method includes sensing a vibratory amplitude of the vibratory mechanism and determining a decoupling point of the vibratory mechanism. An output signal is generated based on the determination of the decoupling point for controlling the vibratory amplitude of the vibratory mechanism.

In another aspect, a control system is provided for controlling a vibratory mechanism. The control system includes a sensor configured to sense a vibratory amplitude and a controller coupled to the sensor. The controller is configured to determine a decoupling point of the vibratory mechanism based on the sensed amplitude and to generate an output signal based on the determination of the decoupling point to control the vibratory amplitude of the vibratory mechanism.

BRIEF DESCRIPTION OF THE DRAWINGS

The accompanying drawings, which are incorporated in and constitute a part of this specification, illustrate exemplary embodiments of the invention and together with the description, serve to explain the principles of the invention.

DETAILED DESCRIPTION

Reference will now be made in detail to exemplary embodiments that are illustrated in the accompanying drawings. Wherever possible, the same reference numbers will be used throughout the drawings to refer to the same or like parts.

Figure 1:
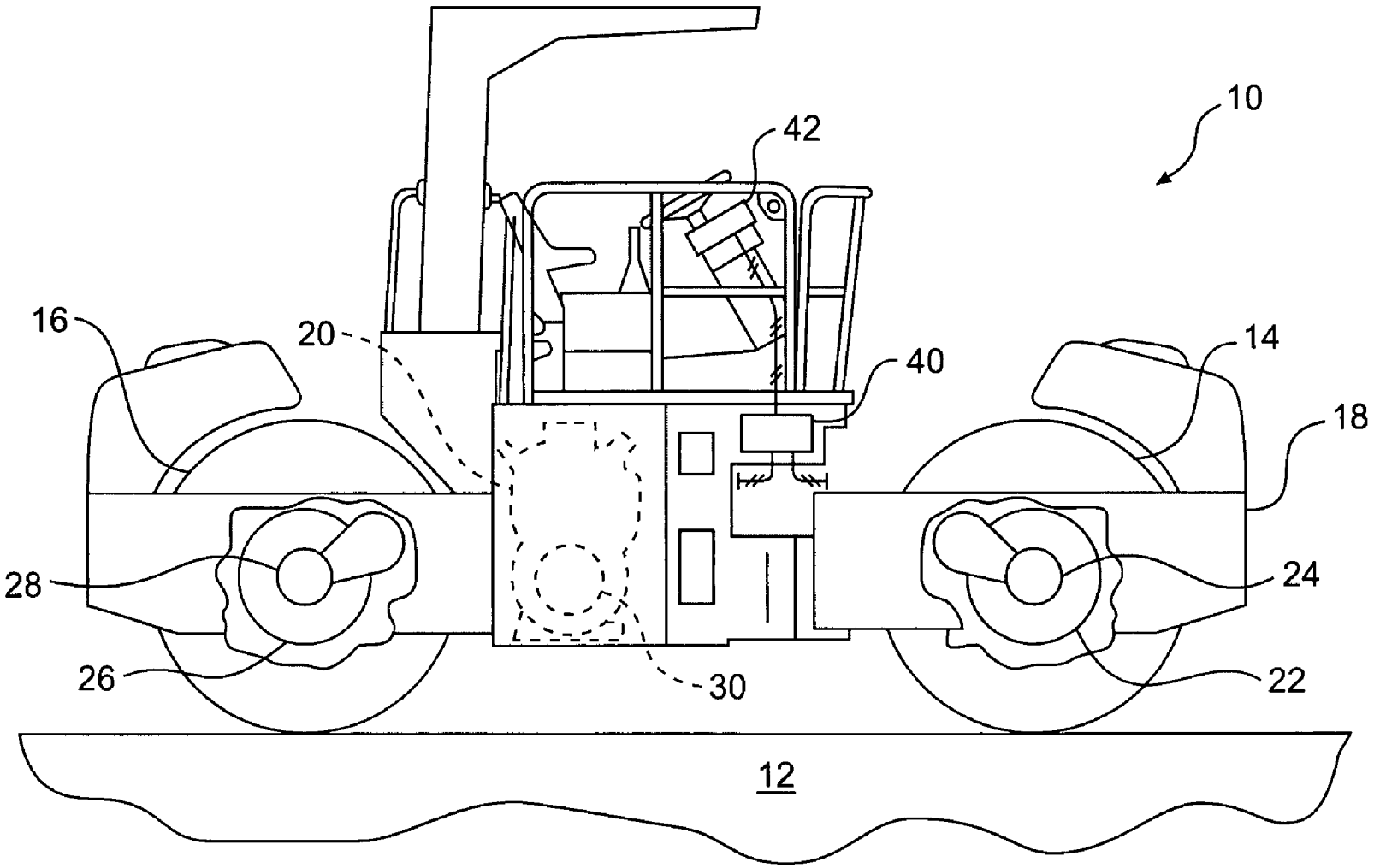
FIG. 1 is a diagrammatic representation of a vibratory work machine with a control system according to one exemplary embodiment.

As shown in FIG. 1, a vibratory work machine may be a double-drum compactor 10 used for compacting a material 12 such as soil, gravel, or asphalt to increase the density of the material. While the control system and method for a vibratory mechanism in a double-drum compactor is described, the control system and method is not limited to this application.

The compactor 10 has a first compacting drum 14 and a second compacting drum 16 rotatably mounted on a main frame 18. The compactor 10 also has an engine 20 that may be used to generate mechanical and/or electrical power for propelling the compactor 10. The first compacting drum 14 includes a first vibratory mechanism 22 that is operatively connected to a first motor 24. The second compacting drum 16 includes a second vibratory mechanism 26 that is operatively connected to a second motor 28. It should be understood from this disclosure that the vibratory work machine may have more or less than two compacting drums and vibratory mechanisms.

The first and second motors 24, 28 propel the first and second compacting drums 14, 16, respectively, and the motors may be operatively coupled to a power source 30, which may be connected to the engine 20. The power source 30 may be an electric generator, a fluid pump or any other suitable device for propelling the compactor 10 and providing power to the first and second vibratory mechanisms 22, 26 and other systems of the compactor 10. Where the power source 30 provides electrical power, the first and second motors 24, 28 may be electric motors. Alternatively, where the power source 30 provides mechanical or hydraulic power, the motors 24, 28 may be fluid motors. The motors 24, 28 may be operatively coupled to the power source 30 with electrical wires, fluid conduits, or any other suitable connection.

Also, the compactor 10 includes a controller 40 that determines a decoupling point of the vibratory mechanisms 22, 26. At the decoupling point, compacting drums 14, 16 lose their surface contact to the material 12, and the vibratory mechanisms or compacting drums become airborne. The controller 34 may also be operatively coupled to an operator or user input 42 that enables the operator of the compactor 10 to set, for example, a desired vibratory control characteristic. The vibratory control characteristic may include a vibratory amplitude limit, which will be explained in detail later. The operator input 42 may be a vibratory control knob, lever, switch or any other suitable device that the operator uses to set the vibratory amplitude characteristic. In one exemplary embodiment, the operator input 42 may be a multi-position switch, and each of the switch positions may correspond to one of amplitude limit settings, such as 50%, 100%, and 150% of the decoupling amplitude. The decoupling amplitude is an amplitude at which the compactor 10 decouples.

Figure 2:
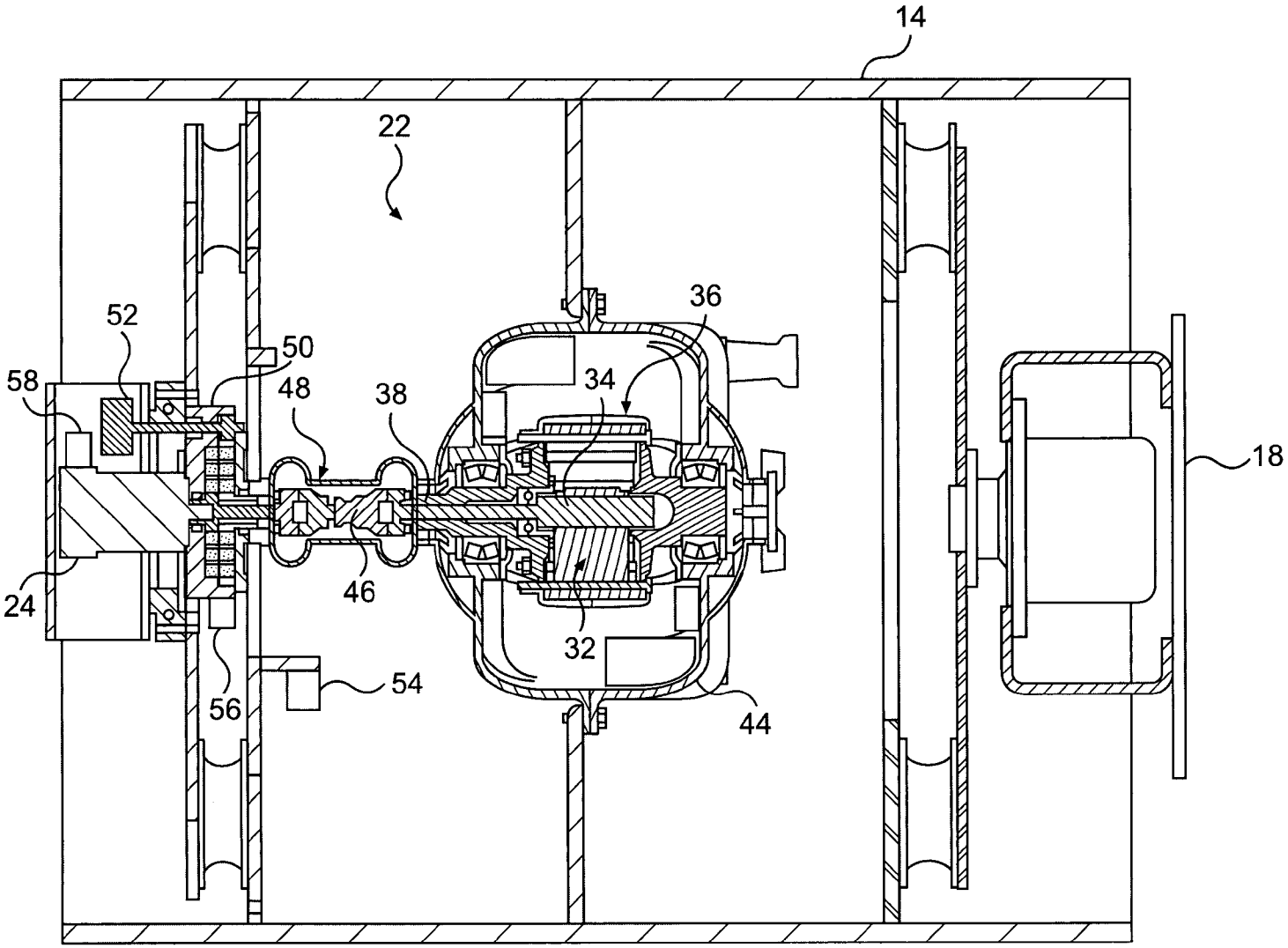
FIG. 2 is a cross-sectional view of a compacting drum of the vibratory work machine of FIG. 1.

FIG. 2 illustrates a cross-sectional view of the first compacting drum 14. The first vibratory mechanism 22 may be approximately centrally mounted within the first compacting drum 14. However, the precise location of the vibratory mechanism 22 may be varied to suit a particular application. While the vibratory mechanism will be described with respect to the first vibratory mechanism 22, the vibratory mechanism shown in FIG. 2 may be used for one or both of the first and second vibratory mechanisms 22, 26 shown in FIG. 1.

In the exemplary embodiment shown in FIG. 2, the vibratory mechanism 22 includes a housing 44 that is rigidly fixed to the compacting drum 14, an inner eccentric weight 32 that is connected to an inner shaft 34, and an outer eccentric weight 36 that is connected to an outer shaft 38. An inner flexible coupling 46 and an outer flexible coupling 48 may be provided for rotating the inner shaft 34 and the outer shaft 38, respectively.

In general, the vibratory mechanism 22 produces independent continuous or infinite variation of both the amplitude and the frequency. For example, the vibratory mechanism 22 changes the relative positions or relative phase of the inner and outer eccentric weights 32, 36 to vary the magnitude of the imbalance and the vibratory amplitude produced by rotation of the inner and outer eccentric weights 32, 36 about their axes. Additionally, the frequency of the vibrations produced by the vibratory mechanism 22 may be varied by changing the rotational speed of the inner and outer weights 32, 36. Thus, the frequency of the vibrations produced by the weights 32, 36 increases as the rotational speed of the weights 32, 36 increases.

The first motor 24 may be connected to the inner and outer couplings 46, 48 via a gearbox 50. A phase control device 52 may be coupled to the gearbox 50 to change the relative positions of the inner and outer shafts 34, 38 and, thus, the relative positions or phase of the inner and outer eccentric weights 32, 36 to be continuously or infinitely varied.

As shown in FIG. 2, the compactor 10 also includes a vibratory amplitude sensor 54. In one example, the vibratory amplitude sensor 54 may be an accelerometer that can sense the amplitude of the vibrations produced by the compactor 10, and it may be fixed to a portion of the compacting drum 14. The accelerometer may also sense the frequency of the vibrations. In addition, the compactor 10 may include a phase sensor 56 connected to the gearbox 50 to measure the relative positions or relative phase of the inner and outer weights 32, 36 and the inner and outer shafts 34, 38. The compactor 10 may also have a speed sensor 58 to measure the rotational speed of the inner and outer weights 32, 36 and the inner and outer shafts 34, 38.

The compactor 10 has the controller 40 electrically connected to the operator input 42, the phase control device 52, and the vibratory amplitude sensor 54. The controller 40 may also be electrically connected to the other sensors. The controller 40 includes a processor for determining the coupling point and generate an output signal to control the amplitude.

Figure 3:
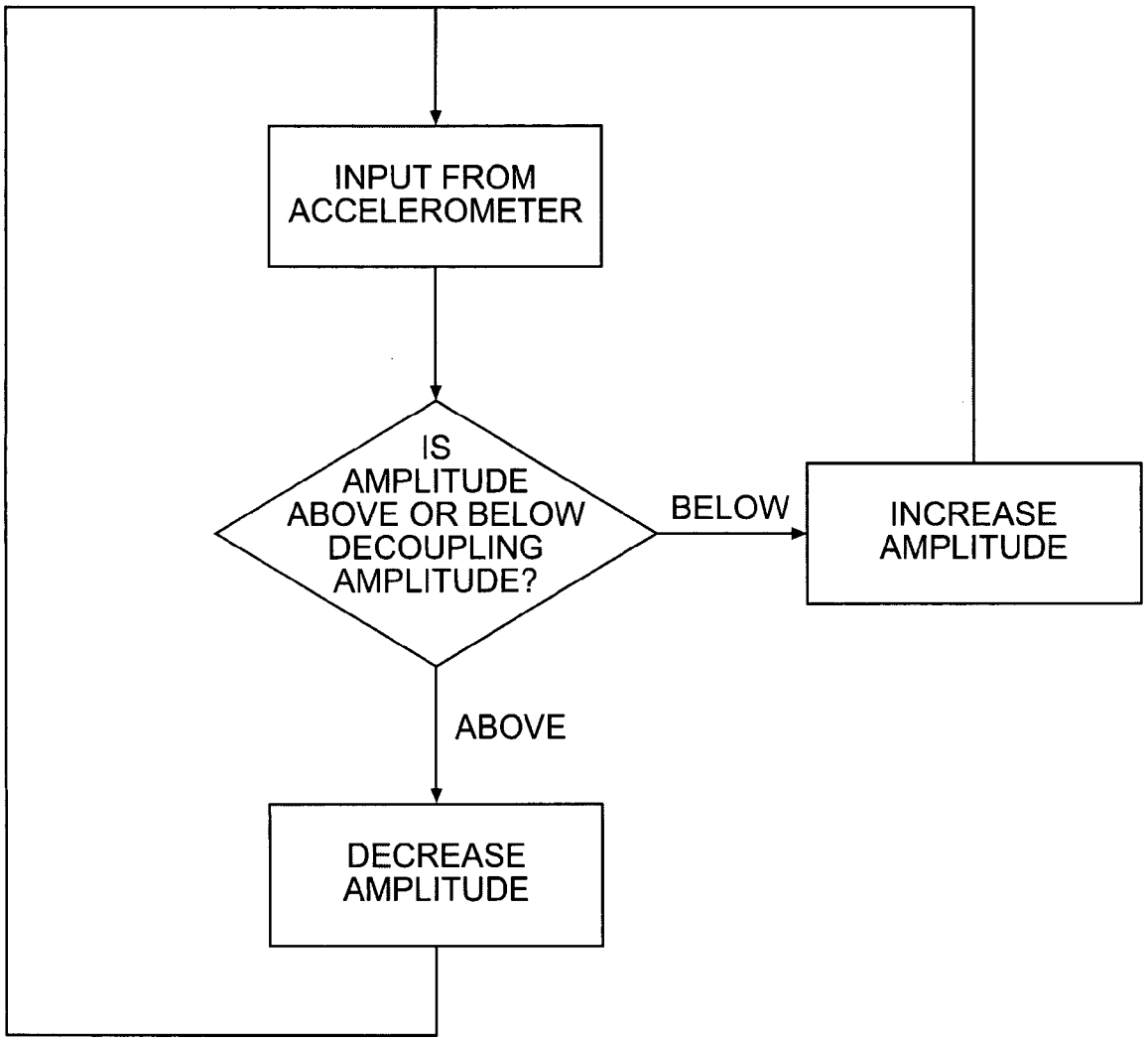
FIG. 3 is a block diagram describing the logic of the control system shown in FIG. 1.

FIG. 3 illustrates a schematic block diagram describing an exemplary logic that may be used with the controller 40 to control the vibration amplitude of the compactor 10 shown in FIG. 1. In one exemplary embodiment, the controller 40 determines a decoupling point of the vibratory mechanism 22 based on the vibratory amplitude sensed by the vibratory amplitude sensor 54 and a predetermined reference vibratory amplitude. The reference vibratory amplitude may be empirically determined, for example, through test runs of the compactor 10 with the drums suspended off the ground, and may be prestored in the controller 40. This predetermined reference vibratory amplitude corresponds to the decoupling point of the vibratory mechanism 22. The reference vibratory amplitude may be in a graphic form, such as a sinusoidal wave.

By comparing the sensed amplitude with the reference amplitude, the controller 40 determines a decoupling point of the vibratory mechanism 22. For example, when the decoupling occurs, the sinusoidal amplitude signal from the sensor 54 may have large amplitude differences between its polarities. Based on the amplitude differences, the controller 40 generates an amplitude control output signal to the vibratory mechanism. In response, the vibratory mechanism vibrates at an amplitude corresponding to the output signal. In one embodiment, the controller 40 may also generate another signal to vary the vibratory frequency of the vibratory mechanism 22 based on the value of the amplitude control output signal.

INDUSTRIAL APPLICABILITY

Referring to FIGS. 1–3, the vibratory amplitude sensor 54, such as an accelerometer, senses a vibratory amplitude of the compactor 10. A signal representing the sensed vibratory amplitude is sent to the controller 40.

Upon receipt of the sensed vibratory amplitude signal, the controller 40 compares the sensed amplitude with a reference amplitude stored in the controller 40. In one example, the reference amplitude may be in a sinusoidal wave form that represents the amplitude at which the vibratory mechanism 22 decouples, i.e., the amplitude at which the compactor 10 becomes airborne. By comparing the sensed amplitude and the reference amplitude, the controller 40 determines whether the sensed amplitude is below or above the reference or decoupling amplitude. In one embodiment, the controller 40 determines whether the sensed amplitude is below or above the reference or decoupling amplitude via analysis of the dynamic signal from the sensor 54. When the controller 40 determines that the sensed amplitude is below the reference amplitude, it will send an output signal to increase the amplitude to the vibratory mechanism 22. On the other hand, when the controller 40 determines that the sensed amplitude is above the reference amplitude, it will send an output signal to decrease the amplitude to the vibratory mechanism 22. Based on the output signal from the controller 40, the vibratory mechanism 22 adjusts the phase or positions of the eccentric weights 32, 36 to alter the amplitude of the vibratory mechanism 22. The controller 40 may repeat these steps in a closed loop manner so that the amplitude of the vibratory mechanism is kept close to the decoupling amplitude.

In one exemplary embodiment, the operator may set an amplitude characteristic, such as an amplitude limit, via the operator input 42. When the operator desired to obtain the optimum compaction result without decoupling, then the amplitude limit should be set to 100% of the decoupling amplitude. If the amplitude limit is set, for example, at 50% of the decoupling amplitude, then the output signal is multiplied by 0.5, and the vibratory mechanism 22 provides the amplitude well below the decoupling amplitude, i.e., 50% of the decoupling amplitude. The operator may choose this low setting when a slow compacting process is desired. On the other hand, if the amplitude limit is set, for example, at 150% of the decoupling amplitude, then the output signal is multiplied by 1.5, and the vibratory mechanism 22 provides the amplitude well above the decoupling amplitude, i.e., 150% of the decoupling amplitude. The operator may choose this high setting to intentionally cause decoupling of the vibratory mechanism 22, for example, when compacting the material at the beginning of the compaction process. Thus, an operator is able to most effectively utilize a compactor for a given application. While these steps are described with respect to the first vibratory mechanism 22, the controller 40 may control the amplitude of the second vibratory mechanism 26 independently in a similar manner.

It will be apparent to those skilled in the art that various modifications and variations can be made in the disclosed system and method without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims.

What is claimed is:

1. A method for controlling a vibratory mechanism, comprising:

sensing a vibratory amplitude of the vibratory mechanism;

determining a decoupling point of the vibratory mechanism;

setting a vibratory amplitude limit by an operator input, the vibratory amplitude limit including a value higher than the decoupling point; and generating an output signal based on the determination of the decoupling point and the vibratory amplitude limit setting for controlling the vibratory amplitude of the vibratory mechanism.

2. The method of claim 1, wherein the decoupling point determination includes comparing the sensed vibratory amplitude with a predetermined reference vibratory amplitude.

3. The method of claim 2, wherein the predetermined reference vibratory amplitude is empirically determined.

4. The method of claim 2, wherein the decoupling point determination includes determining whether the sensed vibratory amplitude is above or below the predetermined reference vibratory amplitude.

5. The method of claim 4, wherein the output signal is generated to increase the vibratory amplitude of the vibratory mechanism when the sensed vibratory amplitude is below the predetermined reference vibratory amplitude.

6. The method of claim 4, wherein the output signal is generated to decrease the vibratory amplitude of the vibratory mechanism when the sensed vibratory amplitude is above the predetermined reference vibratory amplitude.

7. The method of claim 1, further including adjusting weights in the vibratory mechanism based on the generated output signal.

8. The method of claim 1, wherein the vibratory amplitude of the vibratory mechanism is sensed by an accelerometer.

9. A control system for controlling a vibratory mechanism, comprising:

a sensor configured to sense a vibratory amplitude;

a limit input configured to set a vibratory amplitude limit by an operator input; and a controller coupled to the sensor and the limit input, the controller being configured to determine a decoupling point of the vibratory mechanism based on the sensed amplitude and to generate an output signal based on the determination of the decoupling point and the vibratory amplitude limit setting to control the vibratory amplitude of the vibratory mechanism, the vibratory amplitude limit including a value higher than the decoupling point.

10. The control system of claim 9, wherein the controller compares the sensed vibratory amplitude signal with a predetermined reference vibratory amplitude.

11. The control system of claim 10, wherein the controller determines whether the sensed vibratory amplitude is above or below the predetermined reference vibratory amplitude.

12. The control system of claim 11, wherein the output signal is generated to increase the vibratory amplitude of the vibratory mechanism when the sensed vibratory amplitude is below the predetermined reference vibratory amplitude.

13. The control system of claim 11, wherein the output signal is generated to decrease the vibratory amplitude of the vibratory mechanism when the sensed vibratory amplitude is above the predetermined reference vibratory amplitude.

14. The control system of claim 9, wherein the sensor is an accelerometer.

15. A vibratory compactor, comprising:

a compacting drum;

a vibratory mechanism mounted to the compacting drum, the vibratory mechanism being configured to provide a vibratory force to the compacting drum;

a sensor disposed at the compacting drum, the sensor being configured to sense a vibratory amplitude;

a limit input configured to set a vibratory amplitude limit by an operator input; and a controller operatively coupled to the vibratory mechanism, the controller being configured to determine a decoupling point of the vibratory mechanism based on the sensed vibratory amplitude and to generate an output signal based on the determination of the decoupling point and the vibratory amplitude limit setting to control the vibratory amplitude of the vibratory mechanism, the vibratory amplitude limit including a value higher than the decoupling point.

16. The vibratory compactor of claim 15, wherein the controller compares the sensed vibratory amplitude signal with a predetermined reference vibratory amplitude to determine the decoupling point of the vibratory mechanism.

* * * * *